US010353321B2

(12) United States Patent
Furukawa

(10) Patent No.: US 10,353,321 B2
(45) Date of Patent: Jul. 16, 2019

(54) BELT UNIT WITH RECESSES HAVING AUXILIARY RECESSES FORMED THEREIN, TRANSFER UNIT, AND IMAGE FORMING UNIT INCLUDING THE BELT UNIT

(71) Applicant: Oki Data Corporation, Tokyo (JP)

(72) Inventor: Takaaki Furukawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/818,139

(22) Filed: Nov. 20, 2017

(65) Prior Publication Data

US 2018/0149998 A1 May 31, 2018

(30) Foreign Application Priority Data

Nov. 28, 2016 (JP) ..... 2016-229847
Sep. 21, 2017 (JP) ..... 2017-181062

(51) Int. Cl.

| | |
|---|---|
| ***G03G 15/16*** | (2006.01) |
| ***G03G 15/00*** | (2006.01) |
| ***G03G 15/20*** | (2006.01) |
| ***B65H 20/02*** | (2006.01) |
| ***B65H 23/04*** | (2006.01) |

(52) U.S. Cl.

CPC ..... *G03G 15/1615* (2013.01); *B65H 20/02* (2013.01); *B65H 23/046* (2013.01); *G03G 15/161* (2013.01); *G03G 15/162* (2013.01); *G03G 15/5054* (2013.01); *B65H 2801/03* (2013.01); *G03G 15/2057* (2013.01); *G03G 2215/0016* (2013.01)

(58) Field of Classification Search

CPC ..... G03G 15/0189; G03G 15/0806; G03G 15/0818; G03G 15/162; G03G 15/1685; G03G 15/2053; G03G 15/5008; G03G 15/505; G03G 15/5054; G03G 15/754; G03G 15/755; G03G 15/1516; G03G 15/161; G03G 21/0041; G03G 2215/00075; G03G 2215/00139; G03G 2215/00143; G03G 2215/00147; G03G 2215/00151; G03G 2215/00156; G03G 2215/0016; G03G 2215/00164; G03G 2215/00168; G03G 2215/0825; G03G 2215/1623; G03G 2215/1661; G03G 2215/2009; G03G 2215/2016; G03G 2221/1615; G03G 15/1615; G03G 15/2057; B65H 9/18; B65H 23/046; B65H 2553/40; B65H 20/02; B65H 2801/03

See application file for complete search history.

(56) References Cited

U.S. PATENT DOCUMENTS 6,336,025 B1 * 1/2002 Saeki ..... B29C 33/0033 156/137
6,505,028 B1 * 1/2003 Yoda ..... G03G 15/2053 399/122

(Continued)

FOREIGN PATENT DOCUMENTS

JP 2013-218091 A 10/2013

*Primary Examiner* — Joseph S Wong
(74) *Attorney, Agent, or Firm* — Muncy, Geissler, Olds & Lowe, P.C.

(57) ABSTRACT

A belt unit includes a belt that comprises at least one first recess part having an inner wall face and at least one second recess part formed on the inner wall face of the first recess part, and a drive body that drives the belt to rotate.

5 Claims, 6 Drawing Sheets

(56) References Cited

U.S. PATENT DOCUMENTS

| | | | | |
|---|---|---|---|---|
| 8,131,194 | B2 * | 3/2012 | Kakyo | G03G 15/0131 399/302 |
| 8,326,192 | B2 * | 12/2012 | Furuya | G03G 15/0808 399/281 |
| 2003/0026629 | A1 * | 2/2003 | Kawamura | G03G 15/0806 399/281 |
| 2015/0177653 | A1 * | 6/2015 | Seki | G03G 15/162 399/101 |
| 2016/0378036 | A1 * | 12/2016 | Onishi | G03G 15/5054 399/302 |

* cited by examiner

BELT UNIT WITH RECESSES HAVING AUXILIARY RECESSES FORMED THEREIN, TRANSFER UNIT, AND IMAGE FORMING UNIT INCLUDING THE BELT UNIT

TECHNICAL FIELD

This invention relates to a belt unit provided with a belt, and a transfer unit and an image forming apparatus using the belt unit.

BACKGROUND

Electrophotographic image forming apparatuses are widely used. It is because a clear image can be obtained in a short time in comparison with image forming apparatuses using other systems such as an inkjet system.

Adopted as the image forming method of the electrophotographic image forming apparatuses is an intermediate transfer system, and a belt unit (transfer unit) provided with a belt is used in the intermediate transfer system. In the image forming process of the intermediate transfer system, toner adhering to a latent image is temporarily transferred to the belt in the transfer unit, and afterwards transferred from the belt to a medium such as paper.

Concerning the configuration of an image forming apparatus that adopted the intermediate transfer system, various proposals have been already made. Specifically, in order to detect the amount of displacement etc. of the belt, a detection mark (belt marking member) is made on the belt (e.g., see Patent Document 1). This detection mark is detected by an optical reflection sensor (mark detecting sensor).

RELATED ART

[Patent Doc. 1] JP Laid-Open Publication 2013-218091

However, because the detection precision of the detection mark is still not sufficient, there is some room for improvement in the operating performance of the belt unit using the detection mark.

This invention was made considering such a problem, and its objective is to offer a belt unit, a transfer unit, and an image forming apparatus that can enhance the operating performance.

The belt unit of an embodiment of this invention is provided with a belt comprising at least one first recess part having an inner wall face and at least one second recess part provided on the inner wall face of the above-mentioned first recess part, and a drive body that drives the belt.

The transfer unit of an embodiment of this invention is provided with the above belt unit, and a cleaning member that contacts a surface of the belt of the belt unit, the first recess part of the belt being disposed on the surface.

The image forming apparatus of an embodiment of this invention is provided with a development unit that forms a latent image and lets toner adhere to the latent image, the above transfer unit that transfers the toner adhering to the latent image to a medium, and a fuser unit that fuses the toner transferred onto the medium with the medium.

According to the belt unit, the transfer unit, and the image forming apparatus of an embodiment of this invention, at least one first recess part is made on the belt, and at least one second recess part is made on the inner wall face of the first recess part, therefore the operating performance can be enhanced.

BRIEF DESCRIPTIONS OF THE DRAWINGS

DETAILED DESCRIPTIONS OF THE PREFERRED EMBODIMENTS

Below, an embodiment of this invention is explained in detail referring to drawings. Note that the order of the explanations is as follows.

1. Belt unit
   - 1-1. Overall configuration
   - 1-2. Configuration of the detection mark
   - 1-3. Function of the detection mark
   - 1-4. Manufacturing method
   - 1-5. Actions and effects
2. Image forming apparatus (Transfer unit)
   - 2-1. Overall configuration
   - 2-2. Configuration of the development unit
   - 2-3. Operations
   - 2-4. Actions and effects
3. Modifications 1. Belt Unit The belt unit of an embodiment of this invention is explained.

1-1. Overall Configuration

First, the overall configuration of the belt unit of an embodiment of this invention is explained.

The application of the belt unit explained here is not particularly limited. Specifically, the belt unit is used, for example, for an electrophotographic image forming apparatus having adopted the intermediate transfer system as mentioned below. In this case, the belt unit is used, for example, as a transfer unit 40 (see FIG. 8) for transferring toner.

The belt unit used in this image forming apparatus of the intermediate transfer system is provided with a medium (an intermediate medium or an intermediate transfer medium) to which toner is temporarily transferred before the toner is transferred to another medium such as paper (a final medium).

The "final medium" is a medium on which an image is formed by toner being finally transferred, and is paper for example as mentioned above. However, the kind of the final medium is not limited to paper for example, but can be film etc. Of course, the final medium can include two or more kinds such as paper and film.

On the other hand, the "intermediate medium" is a medium to which toner is temporarily transferred before the toner is finally transferred to paper etc. (the final medium). That is, in the image forming process using the transfer unit, toner is tentatively transferred to the intermediate medium, and afterwards transferred from the intermediate medium to the final medium such as paper.

Figure 1:
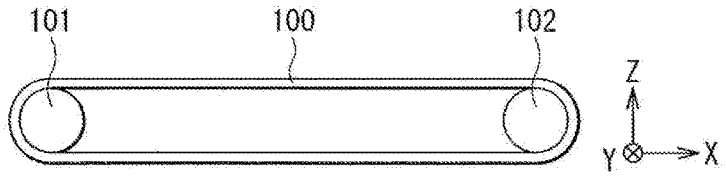
FIG. 1 is an enlarged plan view of the configuration of a belt unit of an embodiment of this invention.
Figure 2:
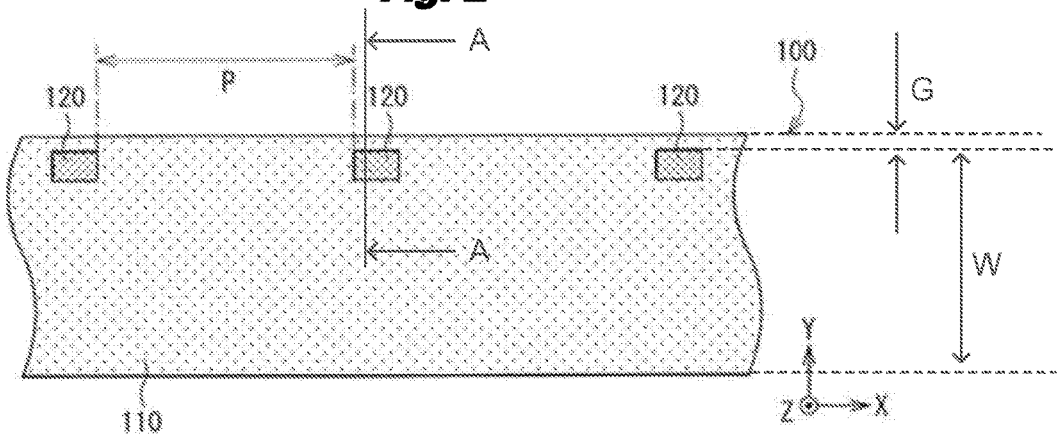
FIG. 2 is an enlarged plan view of the configuration of one of detection marks 120 shown in FIG. 1.

FIG. 1 shows the planar configuration of the belt unit, and FIG. 2 shows an enlarged view of the planar configuration of the main part (a belt 100) of the belt unit shown in FIG. 1. Note that FIG. 1 shows the planar configuration of the belt unit viewed from the Y-axis direction, and FIG. 2 shows the planar configuration of the belt 100 viewed from the Z-axis direction.

The belt unit is provided with, for example, as shown in FIGS. 1 and 2, the belt 100, a driven roller (idle roller) 101, and a drive roller 102 that is the "drive body" of an embodiment of this invention.

Belt:

The belt 100 is provided with, for example, as shown in FIG. 2, a belt member 110 with a detection mark 120 made. This belt 100 is movable according to the rotation of the drive roller 102 in a state of being stretched by the driven roller 101 and the drive roller 102 for example.

In the embodiment(s), the X-axis is determined with a direction along which the medium is carried, or a direction in which the drive and driven rollers are arranged in parallel with a predetermined space therebetween. Their axes of the rollers are perpendicular to the X-axis. The Y-axis is determined with axes of these rollers. The Z-axis is determined with a direction that is perpendicular to both of the X and Y axes, or a perpendicular direction to the planar surface of the belt.

The belt member 110 is a belt-shape member extending in a predetermined direction (the X-axis direction) and contains at least one kind of macromolecular materials etc. for example. The kinds of macromolecular materials are not particularly limited but are polyimide (PI), polyamide-imide (PAI), polyvinylidene fluoride (PVDF), polyetheretherketone (PEEK), polycarbonate (PC), polyphenylene sulfide (PPS), composite rubber, ethylene-tetrafluoroethylene copolymer (ETFE), or the like for example.

The usage mode of the belt member 110 is not particularly limited. Specifically, the belt member 110 can be used in an endless state (or in an endless belt shape) where one end part and the other end part are mutually connected. Alternatively, the belt member 110 can be used in an ended state where one end part and the other end part are not mutually connected but become free ends for example. Here, for example, because the belt member 110 is in an endless state, the belt 100 is an endless belt.

Although the thickness of the belt member 110 is not particularly limited but is 40-1000 μm for example.

The detection mark 120 is made on one face (the front face or outer surface) of the belt member 110 for example. However, for example, the detection mark 120 can be made on the other face (the back face or inner surface) or on both the front face and the back face of the belt member 110. The "front face" of the belt member 110 explained here is, for example, the face opposing a development unit 30 (a photosensitive drum 32) when the belt 100 is built in the below-mentioned image forming apparatus (see FIGS. 8 and 9).

This detection mark 120 is mainly used for detecting the amount of displacement of the belt 100, etc. Thereby, when the belt 100 is moving continuously or intermittently, by detecting the detection mark 120 using the below-mentioned photosensor or the like, the movement amount of the belt 100 can be measured. In this case, even if the belt 100 unintentionally expanded or contracted due to temperature (such as heat), a stress (such as tension), or the like, the movement amount of the belt 100 can also be corrected by detecting the detection mark 120 using the photosensor or the like.

Because the number of the detection marks 120 is not particularly limited, it can be one or more. Shown in FIG. 2 is a case where the number of the detection marks 120 is three, which are two or more.

Here, for example, the belt 100 moves in the longer direction (X-axis direction) of the belt member 110. Along with this, if the number of the detection marks 120 is two or more, those two or more detection marks 120 are arranged in the longer direction of the belt member 110.

The interval P (or distance) between two adjacent detection marks 120 is not particularly limited but is a length that equally divides the length (longer dimension) of the belt member 110 for example. Specifically, the interval P is, for example, a length that divides the length of the belt member 110 into ten equal parts. If the number of the detection marks 120 is three or more, the number of the intervals P becomes two or more, and those two or more intervals P can be either mutually equal or different. Of course, only part of the two or more intervals P can be mutually equal.

The planar shape of the detection mark 120 is not particularly limited but is a square shape for example. Shown in FIG. 2 for example is a case where the planar shape of the detection mark 120 is a rectangle having the long sides along the longer direction of the belt member 110.

The positions of the detection marks 120 are not particularly limited. However, as mentioned above for example, if the belt 100 is used for transferring toner, the positions of the detection marks 120 should preferably be positions that do not overlap with the toner transfer area. Shown in FIG. 2 for example is a case where the detection marks 120 are made on one end side (or at a position close to one edge) in the shorter direction (Y-axis direction) of the belt member 110.

The dimensions of the detection mark 120 are not particularly limited. The dimensions of the detection mark 120 are, if the planar shape of the detection mark 120 is a rectangle for example, the length of the long side and the length of the short side.

Note that the detailed configuration of the detection mark 120 is mentioned below (see FIGS. 3 and 4).

Driven Roller:

The driven roller 101 extends in the Y-axis direction and can rotate centering on the Y-axis. This driven roller 101 can rotate, for example, according to the rotation of the drive roller 102.

Drive Roller:

The drive roller 102 extends in the Y-axis direction in the same manner as the above-mentioned driven roller 101, and can rotate centering on the Y-axis. This drive roller 102 can rotate, for example, by utilizing the drive force of a motor or the like.

1-2. Configuration of the Detection Mark

Next, the configuration of the detection mark 120 is explained.

Figure 3:
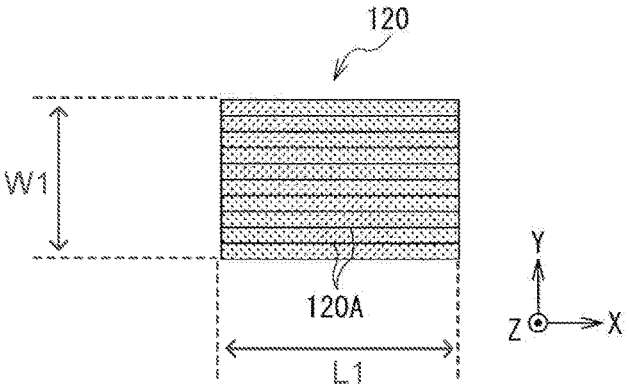
FIG. 3 is an enlarged plan view of the configuration of a detection mark (multiple grooves) shown in FIG. 2.
Figure 4:
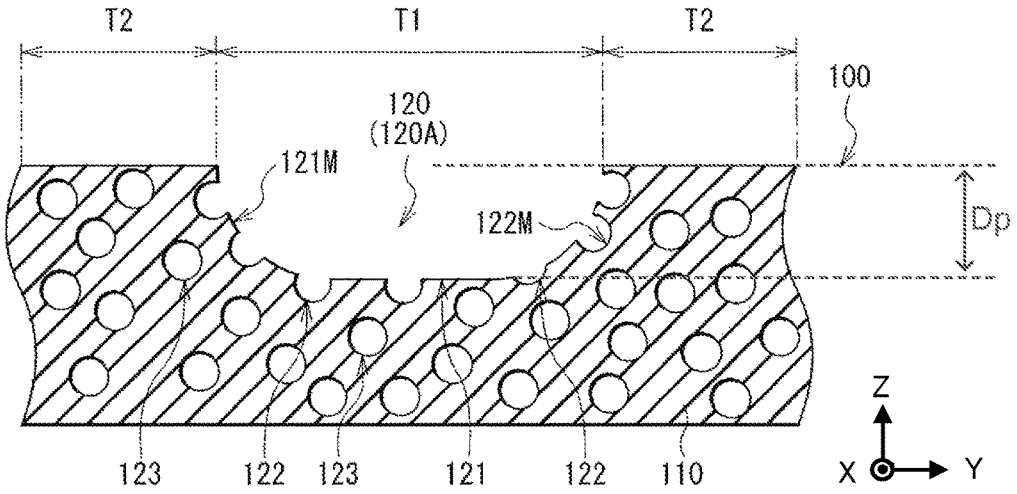
FIG. 4 is an enlarged cross-sectional view of the configuration of the belt along a line A-A shown in FIG. 2.

FIG. 3 shows an enlarged view of the planar configuration of the detection mark 120 (multiple grooves 120A) shown in FIG. 2, and FIG. 4 shows an enlarged view of the cross-sectional configuration of the belt 100 along the line A-A shown in FIG. 2. The detection mark 120 explained here is a mark of a recessed shape as shown in FIG. 4.

This detection mark 120 is, for example, formed on the belt member 110 by removing part of the belt member 110. Specifically, for example, in the manufacturing process of the belt unit, the surface of the belt member 110 is irradiated with laser, and afterwards a desired range (formation range of the detection mark 120) is scanned with laser. Thereby, because part of the belt member 110 is removed, the detection mark 120 is formed.

Here, as shown in FIG. 3 for example, by repeating the laser scan in the direction along the longer direction (X-axis direction) of the belt member 110, multiple grooves 120A are formed on the surface of the belt member 110. Because each of the grooves 120A extends in the X-axis direction, the multiple grooves 120A are arranged in the direction (Y-axis direction) intersecting with the X-axis direction. Therefore, the detection mark 120 is, for example, formed with the multiple grooves 120A. In other words, the detection mark 120 is a collective body of the multiple grooves 120A for example.

This detection mark 120 comprises a main recess part 121 that is the "first recess part" of an embodiment of this invention, and an auxiliary recess part 122 that is the "second recess part" of an embodiment of this invention.

Main Recess Part:

The main recess part 121 is a recess with a large diameter made on one face of the belt member 110. This "large diameter" means that the diameter (opening area) of the main recess part 121 is larger than the diameter of the auxiliary recess part 122.

As mentioned above, because the number of the detection marks 120 is not particularly limited, it can be either one or more. Along with this, because the number of the main recess parts 121 is not particularly limited, it can be either one or more. Shown in FIG. 2 for example is a case where the number of the main recess parts 121 is two or more.

If the number of the detection marks 120 is two or more, the belt member 110 has two or more main recess parts 121 for example. Along with this, the two or more main recess parts 121 are arranged in the longer direction of the belt member 110 in the same manner as the detection marks 120 for example.

The main recess part 121 has an inner wall face 121M, and the state of the inner wall face 121M is not particularly limited. That is, the inner wall face 121M can have either flat part only, curved part only, or both flat part and curved part. In other words, the inner wall face of the main recess part 121 may be composed with planner surfaces, curved surfaces or a combination of those. Above all, the inner wall face 121M should preferably be partially or totally (entirely) curved, and more preferably be totally curved. As mentioned below, the reason is that it becomes easier for light used for detecting the detection mark 120 (detection light) to be scattered by the inner wall face 121M, making it easier for the detection mark 120 to be detected. Shown in FIG. 4 for example is a case where the inner wall face 121M is totally curved.

Because the cross-sectional shape of the main recess part 121 is not particularly limited, it can be either a rectangle, an approximate semicircle, an approximate circle, a shape made by combining two or more kinds of them, or another shape. Above all, the cross-sectional shape of the main recess part 121 should preferably be one of an approximate semicircle and an approximate circle. The reason is that it becomes easier for the detection light to be scattered by the inner wall face 121M, making it easier for the detection mark 120 to be detected. Shown in FIG. 4 for example is a case where the cross-sectional shape of the main recess part 121 is an approximate semicircle. These circular and semicircular shapes may be a circle that having a constant radius or an ellipse of which a radius varies.

The dimensions of the main recess part 121 are not particularly limited. That is, size, depth, etc. of the main recess part 121 can be arbitrarily set. The "size of the main recess part 121" includes, for example, the lengths of the long side and the length of the short side mentioned above.

Auxiliary Recess Part:

The auxiliary recess part 122 is a recess with a small diameter made on the inner wall face 121M of the main recess part 121. This "small diameter" means that the diameter (opening area) of the auxiliary recess part 122 is smaller than the diameter of the main recess part 121.

The reason why the detection mark 120 has the auxiliary recess part 122 along with the main recess part 121 is that it becomes easier for the detection light to be scattered by the detection mark 120 than when the detection mark 120 has only the main recess part 121, making it easier for the detection mark 120 to be detected. The detailed reason why it becomes easier for this detection mark 120 to detect is mentioned below.

Because the number of the auxiliary recess parts 122 is not particularly limited, it can be either one or more. Above all, the number of the auxiliary recess parts 122 should desirably be two or more. The reason is that it becomes easier for the detection light to be scattered by the detection mark 120, making it easier for the detection mark 120 to be detected. Shown in FIG. 4 for example is a case where the number of the auxiliary recess parts 122 is six (namely, two or more).

To explain for confirmation, as is clear from FIG. 4, because two or more auxiliary recess parts 122 are made on the inner wall face 121M of the main recess part 121 here, naturally the diameter of each of the auxiliary recess parts 122 becomes smaller than the diameter of the main recess part 121.

The auxiliary recess part 122 has an inner wall face 122M, and the state of the inner wall face 122M of the auxiliary recess part 122 is not particularly limited. That is, the inner wall face 122M can either comprise flat part only, curved part only, or both flat part and curved part. In other words, the inner wall face of the auxiliary recess part may be composed with planner surfaces, curved surfaces or a combination of those. Above all, the inner wall face 111M should preferably be partially or totally curved, and more preferably be totally curved. As mentioned below, the reason is that it becomes easier for the detection light to be scattered by the inner wall face 122M, making it easier for the detection mark 120 to be detected. Shown in FIG. 4 for example is a case where the inner wall face 122M is totally curved.

Because the cross-sectional shape of the auxiliary recess part 122 is not particularly limited, it can be either a rectangle, an approximate semicircle, an approximate circle, a shape made by combining two or more kinds of them, or another shape. Above all, the cross-sectional shape of the auxiliary recess part 122 should preferably be one of an approximate semicircle and an approximate circle. The reason is that it becomes easier for the detection light to be scattered by the inner wall face 122M, making it easier for the detection mark 120 to be detected. Shown in FIG. 4 for example is a case where the cross-sectional shape of the auxiliary recess part 122 is either a semicircle or an approximate circle.

The dimensions of the auxiliary recess part 122 are not particularly limited. That is, size, depth, etc. of the auxiliary recess part 122 can be arbitrarily set. The "size of the auxiliary recess part 122" is, for example, the diameter (inner diameter of the opening part) or the like of the auxiliary recess part 122.

The surface roughness of the detection mark 120, that is, the surface roughness of the main recess part 121 with the auxiliary recess part 122 made is not particularly limited. In other word, such a roughness is determined at inner wall face 121M. Above all, the surface roughness of the detection mark 120 should preferably satisfy the following conditions.

First, 10-point average roughness Rzjis (μm) of the detection mark 120 measured using a laser microscope is denoted as "10-point average roughness Rz1". This 10-point average roughness Rz1 should preferably be 1.0-5.0 μm. The reason is that it becomes easier for the detection light to be scattered sufficiently by the detection mark 120, making it easier for the detection mark 120 to be detected.

The laser microscope used for measuring the 10-point average roughness Rz1 is, for example, an ultra-deep profile measuring microscope VK8500 of Keyence Corporation. The measurement conditions are set as, for example, magnification=1000 times, and measured range=10 μm×10 μm.

Secondly, 10-point average roughness Rzjis of the detection mark 120 measured using a two-dimensional surface roughness meter (contact-type roughness meter) is denoted as "10-point average roughness Rz2". This 10-point average roughness Rz2 should preferably be inclusively 4.0-8.2 μm, and more preferably be 4.6-8.2 μm. The reason is that sufficient recesses and projections are formed inside the detection mark 120, and that it becomes harder for toner to invade the interior of the detection mark 120 (the main recess part 121 and the auxiliary recess part 122). Thereby, it becomes significantly easier for the detection light to be scattered by the detection mark 120, making it significantly easier for the detection mark 120 to be detected.

To be more detailed, if the 10-point average roughness Rz2 is smaller than 4.0 μm, because the 10-point average roughness Rz2 is too small, it becomes harder for sufficient recesses and projections to be formed inside the detection mark 120.

In this case, for example, when the belt unit (belt 100) is built in the image forming apparatus mentioned below (see FIGS. 8 and 9), it becomes easier for unnecessary toner adhering to the surface of the belt 100 (belt member 110) to be scraped off by a cleaning blade 47 mentioned below (see FIG. 8). Thereby, it becomes harder for toner to invade the interior of the detection mark 120 (the main recess part 121 and the auxiliary recess part 122), suppressing the phenomenon that it becomes harder for the detection light to be scattered by the detection mark 120 due to the toner invasion.

However, because it becomes harder for recesses and projections that can sufficiently scatter the detection light to be formed inside the detection mark 120, it becomes harder for the detection light to be scattered sufficiently by the detection mark 120.

On the other hand, if the 10-point average roughness Rz2 is larger than 8.2 μm, because the 10-point average roughness Rz2 is too large, excessive recesses and projections are formed inside the detection mark 120.

In this case, because it becomes easier for recesses and projections that can sufficiently scatter the detection light to be formed inside the detection mark 120, it becomes easier for the detection light to be scattered sufficiently by the detection mark 120.

However, because unnecessary toner adhering to the surface of the belt 100 slips through the cleaning blade 47, it becomes harder for the toner to be scraped off by the cleaning blade 47, therefore it becomes easier for toner to invade the interior of the detection mark 120. Thereby, especially because toner becomes more easily stuffed in the auxiliary recess part 122, it becomes harder for the detection light to be scattered sufficiently by the detection mark 120.

As opposed to this, if the 10-point average roughness Rz2 is 4.0-8.2 μm, because the 10-point average roughness Rz2 becomes optimized, it becomes easier for proper recesses and projections to be formed inside the detection mark 120.

In this case, because it becomes easier for recesses and projections that can sufficiently scatter the detection light to be formed inside the detection mark 120, it becomes easier for the detection light to be scattered sufficiently by the detection mark 120.

In addition, because it becomes harder for unnecessary toner adhering to the surface of the belt 100 to invade the interior of the detection mark 120, it becomes easier for the toner to be scraped off by the cleaning blade 47. Thereby, especially because it becomes harder for toner to be stuffed in the auxiliary recess part 122, it becomes easier for the detection light to be scattered by the detection mark 120.

The two-dimensional surface roughness meter used for measuring the 10-point average roughness Rz2 is, for example, a surface roughness and contour measuring instrument SEF3500 manufactured by Kosaka Laboratory Ltd. The measurement conditions are, for example, measured length=7 mm, cutoff type=Gaussian, measuring speed=0.2 mm/s, stylus=R 2 μm.

Here, if the detection mark 120 (main recess part 121) is formed by scanning the surface of the belt member 110 with laser as mentioned below, the direction to measure the 10-point average roughness Rz2 is set to, for example, the direction intersecting with the laser scanning direction. Specifically, for example, if laser scanning is performed in the X-axis direction as mentioned above, the direction to measure the 10-point average roughness Rz2 is set to the Y-axis direction.

In this case, for example, by changing at least one kind of the laser irradiation conditions, the 10-point average roughness Rz2 can be set so as to become a desired value. These laser irradiation conditions are, for example, intensity (output), scanning speed, and number of scans.

Note that each of the values of the above-mentioned 10-point average roughnesses Rz1 and Rz2 is a value rounded off to the one decimal place.

Here, the belt member 110 internally has multiple voids 123 for example. The reason is that it becomes easier for the auxiliary recess part 122 to be formed by utilizing the multiple voids 123. In this case, the auxiliary recess part 122 is part of multiple voids 123 exposed on the inner wall face 121M of the main recess part 121 when forming the main recess part 121 for example. Note that the details of the manufacturing method of the belt 100 are mentioned below (see FIG. 6).

The average particle size (median diameter D50) of the multiple voids 123 is not particularly limited but is 0.05-5 μm for example.

Areas T1 and T2 shown in FIG. 4 indicate two kinds of areas distinguished according to the presence/absence of the detection mark 120 on the surface area of the belt 100. The area T1 is an area where the detection mark 120 is made (a marking area), and the area T2 is an area where the detection mark 120 are not made (a non-marking area).

1-3. Function of the Detection Mark

Next, the function of the detection mark 120 is explained.

Figure 5:
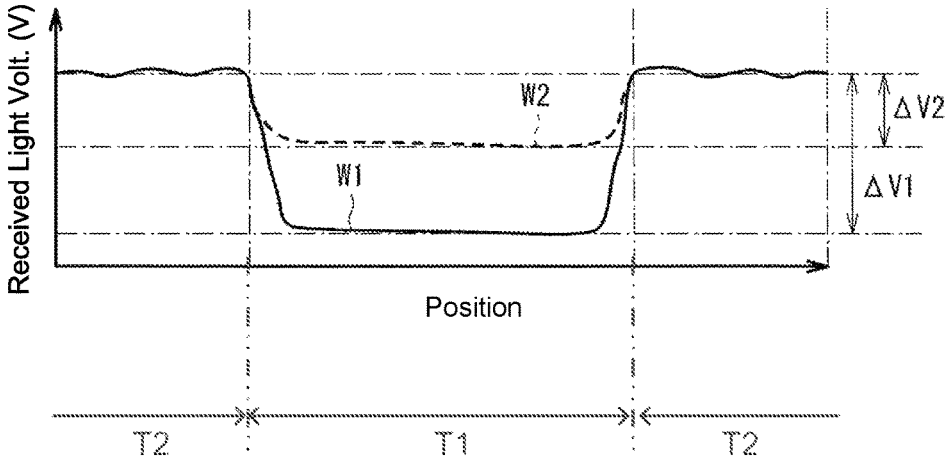
FIG. 5 is a plot showing waveforms of a received light voltage of a photosensor when a detection mark is detected.

Shown in FIG. 5 are waveforms of a received light voltage V of the photosensor when the detection mark 120 is detected. This received light voltage V is a value obtained by converting the amount of light received by the photosensor into a voltage. In FIG. 5, the horizontal axis indicates the position on the surface of the belt 100 in the longer direction (moving direction), and the vertical axis indicates the detection result by the photosensor read using an oscilloscope (results of measuring the received light voltage V). Note that a waveform W1 (a solid line) shown in FIG. 5 represents a waveform concerning the belt unit (belt 100) of an embodiment of this invention.

In detecting the detection mark 120 using the photosensor, while moving the belt 100 in the longer direction, the detection mark 120 made on the belt 100 is detected. The moving speed of the belt 100 is, for example, 6 ips. The detection frequency of the photosensor is, for example, 1 time/1.6 μs.

The detection mark 120 made on the belt 100 is, for example, detected by a photosensor. The kind of the photosensor is not particularly limited but is a reflection-type photosensor for example. This photosensor, for example, radiates the detection light onto the surface of the belt 100 and detects light (receives light) reflected by the surface of the belt 100.

When the light reflection state on the surface of the belt 100 is examined using the photosensor, the light reflection state varies according to the surface condition (presence/absence of the detection mark 120) of the belt 100.

Specifically, as shown in FIG. 4, in the area T2 where the detection mark 120 is not made, because the surface of the belt 100 is almost flat, when the light reflection state is examined using the photosensor, the amount of received light becomes sufficiently large relative to the amount of radiated light. Therefore, as shown in FIG. 5, the received light voltage V becomes sufficiently high in the area T2.

As opposed to this, as shown in FIG. 4, in the area T1 where the detection mart 120 is made, because the surface of the belt 100 is recessed mainly because of the presence of the main recess part 121, when the light reflection state is examined using the photosensor, the amount of received light becomes sufficiently small relative to the amount of radiated light. Therefore, as shown in FIG. 5, the received light voltage V becomes sufficiently low in the area T1.

In this case, especially when the belt 100 (detection mark 120) is irradiated with light, light is scattered by not only the inner wall face 121M of the main recess part 121 but also the inner wall face 122M of the auxiliary recess part 122, therefore the amount of received light significantly decreases.

Also, the larger the number of the auxiliary recess parts 122 is, the more easily light is scattered by the inner wall face 122M of the auxiliary recess part 122, therefore the amount of received light further decreases.

Based on these, as shown in FIG. 5, a received light voltage difference ΔV (ΔV1) that is the difference between the received light voltage V in the area T1 and the received light voltage V in the area T2 becomes sufficiently large. This "received light voltage difference ΔV1" is a value obtained by converting the difference between the amount of received light in the area T1 and the amount of received light in the area T2 into a voltage. Therefore, by using the detection mark 120 having the auxiliary recess part 122 along with the main recess part 121, based on the sufficiently large received light voltage difference ΔV1 mentioned above, the amount of displacement of the belt 100 etc. can be detected with high precision.

1-4. Manufacturing Method

Next, the manufacturing method of the belt unit is explained. Referred to here is the manufacturing method of the belt 100 that is the main part of the belt unit.

Figure 6:
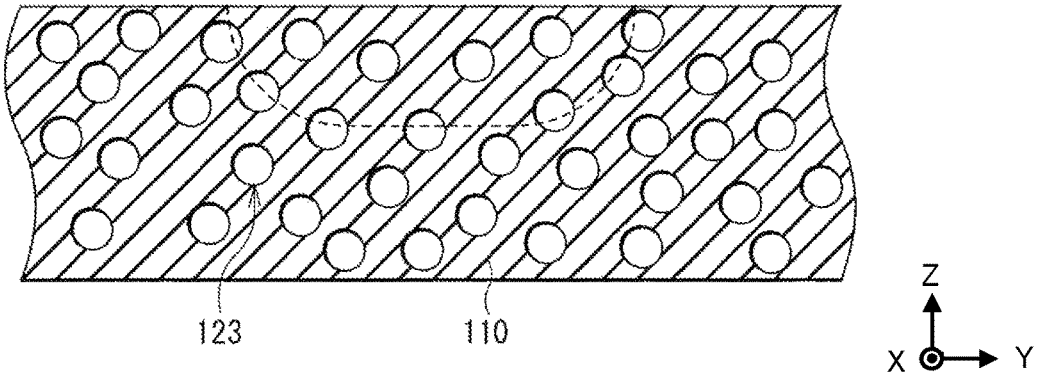
FIG. 6 is a cross-sectional view for explaining the manufacturing method of the belt.

In order to explain the manufacturing method of the belt 100, the cross-sectional configuration of the belt member 110 in a state where the detection mark 120 is not formed yet is shown in FIG. 6, corresponding to FIG. 4. Here, shown as an example is a case where the belt member 110 internally has multiple voids 123.

In manufacturing the belt 100, first as shown in FIG. 6, the belt member 110 internally having the multiple voids 123 is prepared. The multiple voids 123 can be formed in advance, for example, without using a foaming agent by adjusting the manufacturing conditions in manufacturing the belt member 110 (such in molding it). Alternatively, the multiple voids 123 can be formed in advance, for example, by adding a foaming agent to the forming materials of the belt member 110 and utilizing the foaming function of the foaming agent. Other than these, in order to form the multiple voids 123, for example, a method disclosed in Japanese Unexamined Patent Application 2015-102601 can be utilized in forming the belt member 110.

Subsequently, by irradiating part of the surface of the belt member 110 with laser, and repeatedly scanning a desired range (formation range of the detection mark 120) with laser, the part of the belt member 110 is removed. The kind of laser is not particularly limited as far as it can process the belt member 110 with desired precision. A broken line shown in FIG. 6 indicates the range where the belt member 110 is partially removed.

Here, although the laser scanning direction is not particularly limited, above all, it should preferably be the X-axis direction. As mentioned above, the reason is that when the belt unit is built in the image forming apparatus provided with the cleaning blade 47 (see FIGS. 8 and 9), it becomes harder for the cleaning blade 47 to be damaged.

To be more detailed, as mentioned below for example, in order to scrape off unnecessary toner adhering to the surface of the belt 100, the cleaning blade 47 extends in the Y-axis direction and is contacted by (pressed against) the belt 100.

In order to form the detection mark 120 (multiple grooves 120A), if laser scanning is performed in the Y-axis direction, the grooves 120A are formed so as to extend in the Y-axis direction. In this case, because the extending direction of the cleaning blade 47 and the extending direction of the grooves 120A are mutually common, when the cleaning blade 47 is pressed against the belt 100, it becomes easier for part of the cleaning blade 47 to be caught by one of the grooves 120A. Therefore, it becomes easier for part of the cleaning blade 47 to be chipped, making it easier for the cleaning blade 47 to be damaged.

As opposed to this, in order to form the detection mark 120 (multiple grooves 120A), if laser scanning is performed in the X-axis direction, the grooves 120A are formed so as to extend in the X-axis direction. In this case, because the extending direction of the cleaning blade 47 and the extending direction of the grooves 120A are mutually different, when the cleaning blade 47 is pressed against the belt 100, it becomes harder for part of the cleaning blade 47 to be caught by one of the grooves 120A. Therefore, it becomes harder for part of the cleaning blade 47 to be chipped, making it harder for the cleaning blade 47 to be damaged.

Thereby, as shown in FIG. 4, the main recess part 121 is formed in the place where the belt member 110 is partially removed. In addition, because the multiple voids 123 are exposed on the inner wall face 121M of the main recess part 121 when the main recess part 121 is formed, the auxiliary recess part 122 is formed. In this case, if one void 123 is exposed on the inner wall face 121M, one auxiliary recess part 122 is formed, and if two or more voids 123 are exposed, two or more auxiliary recess parts 122 are formed. In this manner, by using the belt member 110 having the multiple voids 123, because the auxiliary recess part 122 is also formed when the main recess part 121 is formed, the auxiliary recess part 122 can be easily formed.

Therefore, the detection mark 120 having the main recess part 121 and the auxiliary recess part 122 is formed, completing the belt 100.

1-5. Actions and Effects

In this belt unit, the main recess part 121 is made on the belt 100 (belt member 110), and the auxiliary recess part 122 is made on the inner wall face 121M of the main recess part 121, thereby forming the detection mark 120. In this case, because of the reason explained below, the operating performance of the belt unit can be enhanced.

Figure 7:
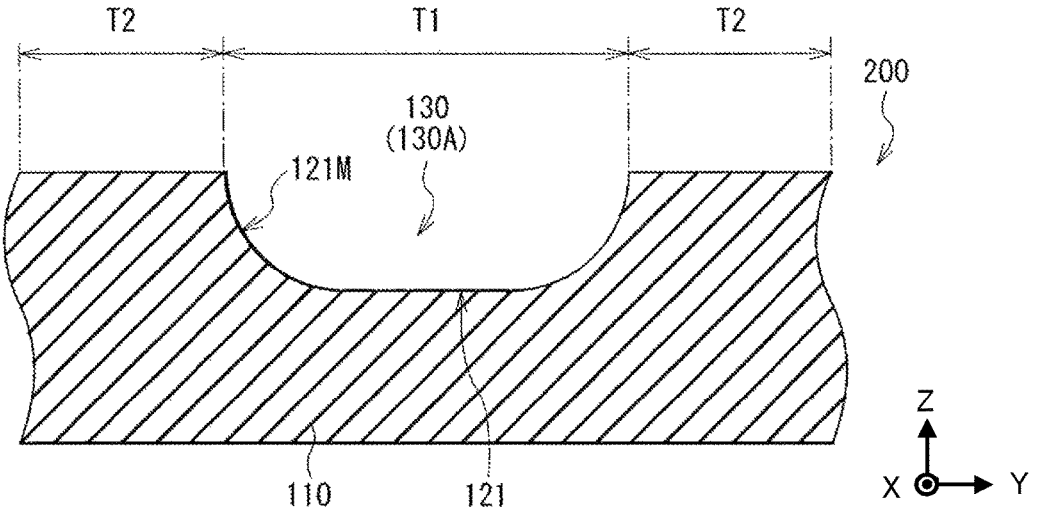
FIG. 7 is a cross-sectional view showing the configuration of a belt unit (belt) of a comparative example.

Shown in FIG. 7 is the cross-sectional configuration of a belt unit (belt 200) of a comparative example, corresponding to FIG. 4. Note that a waveform W2 (a broken line) shown in FIG. 5 represents a waveform concerning the belt unit (belt 200) of the comparative example.

The belt unit of the comparative example has the same configuration as the belt unit of this embodiment except for being provided with a transfer belt 200 having a detection mark 130 (multiple grooves 130A extending in the X-axis direction) made instead of the transfer belt 100 having the detection mark 120 (multiple grooves 120A extending in the X-axis direction) made. This detection mark 130 has the same configuration as the detection mark 120 except for having only the main recess part 121 without the auxiliary recess part 122.

In the belt unit of the comparative example, as shown in FIG. 7, when the detection mark 130 is irradiated with light, the light is scattered only by the inner wall face 121M of the main recess part 121. In this case, in the area T1 where the detection mark 130 is made, the amount of received light does not become sufficiently small relative to the amount of radiated light. Thereby, as shown in FIG. 5, because a received light voltage difference ΔV (ΔV2) does not become sufficiently large, it is hard to detect the detection mark 130 with high precision using the photosensor. Therefore, it is hard to enhance the operating performance of the belt unit.

Note that if the main recess part 121 is formed utilizing the above-mentioned laser irradiation process for manufacturing the belt 200, because part of the belt member 110 is burnt in the laser irradiation process, a carbon residue (so-called soot) adheres to the inner wall face 121M of the main recess part 121. In this case, because the carbon residue performs a role of scattering light, there is a possibility that the received light voltage difference ΔV2 becomes large for a certain period after forming the main recess part 121.

However, once the belt 200 is repeatedly used, the amount of the carbon residue adhering to the inner wall face 121M decreases due to friction with the belt 200 and a photosensitive drum 32 mentioned below (see FIG. 9). Therefore, once the carbon residue finally disappears, because the received light voltage difference ΔV2 significantly decreases, after all, it becomes hard to detect the detection mark 130 with high precision as mentioned above.

As opposed to this, in the belt unit (belt 100) of this embodiment, as shown in FIG. 4, when the detection mark 120 is irradiated with light, the light is scatted by not only the inner wall face 121M of the main recess part 121 but also the inner wall face 122M of the auxiliary recess part 122. In this case, in the area T1 where the detection mark 120 is made, the amount of received light becomes sufficiently small relative to the amount of radiated light. Thereby, as shown in FIG. 5, because the received light voltage difference ΔV1 becomes sufficiently large, the detection mark 120 can be detected with high precision using the photosensor. Therefore, the detection precision of the detection mark 120 is enhanced, also enhancing the operating performance of the belt unit.

In addition, in the belt 100, light is sufficiently scattered utilizing a complex recess-projection structure formed by the main recess part 121 and the auxiliary recess part 122. In this case, because the received light voltage difference ΔV1 becomes sufficiently large independently of the presence/absence of the above-mentioned carbon residue, a sufficient received light voltage difference ΔV1 is maintained even after the carbon reside disappeared. Therefore, without depending on the presence/absence of the carbon residue, the detection mark 120 can be detected with high precision using the photosensor.

In this belt 100, especially if the inner wall face 121M of the main recess part 121 is partially or totally curved, it becomes easier for light to be scattered by the inner wall face 121M, therefore higher effects can be obtained. In the same manner, if the inner wall face 122M of the auxiliary recess part 122 is partially or totally curved, it becomes easier for light to be scattered by the inner wall face 122M, therefore higher effects can be obtained.

Also, if the belt member 110 internally has the multiple voids 123, when the main recess part 121 is formed by removing part of the belt member 110, the voids 123 are exposed on the inner wall face 121 of the main recess part 121, thereby forming the auxiliary recess part 122. That is, utilizing the multiple voids 123, the auxiliary recess part 122 is formed together with the main recess part 121. Thus, because it becomes easier for the auxiliary recess part 122 to be formed, the detection mark 120 can be easily formed while enhancing the detection precision of the detection mark 120.

Also, in the case where the belt 100 is provided with multiple detection marks 120 (main recess parts 121 and auxiliary recess parts 122), if the multiple detection marks 120 (main recess parts 121) are arranged in the longer direction of the belt member 110, the amount of displacement etc. of the belt 100 can be detected in detail by utilizing the multiple detection marks 120. Therefore, the amount of displacement etc. of the belt 100 can be detected with high precision.

Also, if the 10-point average roughness Rz1 of the detection mark 120 is 1-5 μm, because it becomes easier for light to be sufficiently scattered by the detection mark 120, higher effects can be obtained. In this case, if the 10-point average roughness Rz2 of the detection mark 120 is 4.0-8.2 μm, because it becomes significantly easier for light to be scattered by the detection mark 120, even higher effects can be obtained.

2. Image Forming Apparatus

Next, explained is the image forming apparatus of an embodiment of this invention using the above-mentioned belt unit. Note that because the transfer unit of an embodiment of this invention is part of the image forming apparatus explained here, the transfer unit is explained together below.

The image forming apparatus explained here is, for example, an apparatus that forms an image on the surface of a medium M mentioned below (see FIG. 8) using toner, and is so-called an electrophotographic full-color printer. This image forming apparatus especially adopts the intermediate transfer system that forms an image using the belt unit as the transfer unit 40. This medium M is the final medium mentioned above.

Note that the average particle size of the toner is not particularly limited. Specifically, the volume average particle size of the toner is, for example, 5-8 μm, and preferably 7-8 μm.

2-1. Overall Configuration

First, the overall configuration of the image forming apparatus is explained. Below, the above-mentioned belt unit components are cited at any time.

Figure 8:
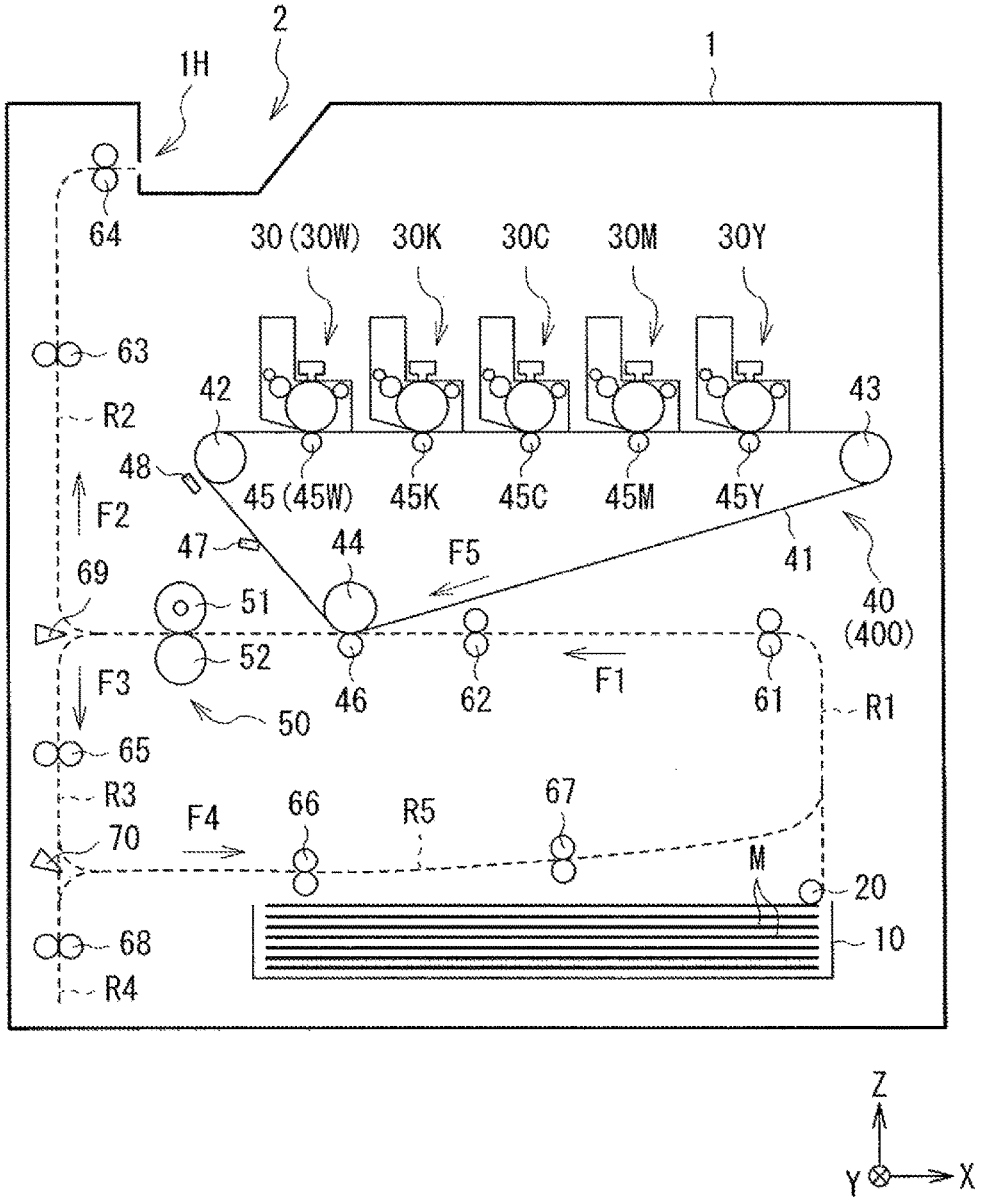
FIG. 8 is a plan view showing the configuration of an image forming apparatus of an embodiment of this invention.

Shown in FIG. 8 is the planar configuration of the image forming apparatus. In this image forming apparatus, the medium M is carried along carrying routes R1-R5. Note that each of the carrying routes R1-R5 is shown in a broken line in FIG. 8.

As shown in FIG. 8 for example, the image forming apparatus is provided with, inside a chassis 1, a tray 10, a forwarding roller 20, a development unit 30, a transfer unit 40, a fuser unit 50, carrying rollers 61-68, and carrying route switching guides 69 and 70.

Chassis:

The chassis 1 contains, for example, at least one kind of metallic materials, macromolecular materials, etc. The chassis 1 is provided with a stacker part 2 for ejecting the medium M with an image formed, and the medium with the image formed is ejected through an ejection port 1H made on the chassis 1.

Tray and Forwarding Roller:

The tray 10 is detachably attached to the chassis 1 for example, and contains the medium M. The forwarding roller 20 extends in the Y-axis direction for example, and can rotate centering on the Y-axis. Among a series of components explained hereafter, the components having "roller" in their names extend in the Y-axis direction and can rotate centering on the Y-axis in the same manner as the forwarding roller 20.

In the tray 10, for example, multiple pieces of the medium M are contained in a stacked state. The multiple pieces of the medium M contained in this tray 10 are, for example, extracted one by one from the tray 10 by the forwarding roller 20.

Because the number of the trays 10 and the number of the forwarding rollers 20 are not particularly limited, they can be either only one or more. Shown in FIG. 8 for example is a case where the number of trays 10 is one and the number of the forwarding rollers 20 is one.

Development Unit:

The development unit 30 performs a development process using toner. Specifically, the development unit 30 mainly forms a latent image (an electrostatic latent image) and lets the toner adhere to the electrostatic latent image utilizing the Coulomb force.

Because the number of the development units 30 is not particularly limited, it can be either only one or more. Here, the image forming apparatus is provided with, for example, five development units 30 (30W, 30K, 30C, 30M, and 30Y).

The development units 30W, 30K, 30C, 30M, and 30Y are, for example, detachably attached to the chassis 1, and arranged along the moving route of an intermediate transfer belt 41 mentioned below. Here, the development units 30W, 30K, 30C, 30M, and 30Y are, for example, disposed in this order from the upstream side toward the downstream side in the moving direction (an arrow F5) of the intermediate transfer belt 41.

The development units 30W, 30K, 30C, 30M, and 30Y have the same configuration except that, for example, the kinds (colors) of toner contained in their toner cartridges are different. In the toner cartridge of the development unit 30W, for example, white toner is contained. In the toner cartridge of the development unit 30K, for example, black toner is contained. In the toner cartridge of the development unit 30C, for example, cyan toner is contained. In the toner cartridge of the development unit 30M, for example, magenta toner is contained. In the toner cartridge of the development unit 30Y, for example, yellow toner is contained.

Note that the detailed configuration of the development unit 30 (30W, 30K, 30C, 30M, and 30Y) is mentioned below (see FIG. 9).

Transfer Unit:

The transfer unit 40 performs a transfer process using toner that is development-processed by the development unit 30. Specifically, the transfer unit 40 mainly transfers toner adhering to the electrostatic latent image by the development unit 30 to the medium M.

This transfer unit 40 is provided with a belt unit 400 having the same configuration as the belt unit of an embodiment of this invention mentioned above, and the cleaning blade 47 that is the "cleaning member" of an embodiment of this invention.

This belt unit 400 includes an intermediate transfer belt 41 corresponding to the belt 100, a driven roller 42 corresponding to the driven roller 101, and a drive roller 43 corresponding to the drive roller 102.

Note that the transfer unit 40 can further include at least one kind of other components for example. Here, the transfer unit 40 further includes, for example, a backup roller 44, a primary transfer roller 45, a secondary transfer roller 46, and a photosensor 48.

The intermediate transfer belt 41 is a medium to which toner is temporarily transferred before the toner is transferred to the medium M, and is the intermediate medium mentioned above. In a state of being stretched by the driven roller 42, the drive roller 43, and the backup roller 44 for example, this intermediate transfer belt 41 can move according to the rotation of the drive roller 43.

The drive roller 43 can rotate by utilizing the drive force of a motor for example. The driven roller 42 and the backup roller 44 can rotate according to the rotation of the drive roller 43 for example.

The primary transfer roller 45 transfers (primary-transfers) toner adhering to the electrostatic latent image to the intermediate transfer belt 41. This primary transfer roller 45 is pressed against the development unit 30 (photosensitive drum 32 mentioned below) through the intermediate transfer belt 41. Note that the primary transfer roller 45 can rotate according to the movement of the intermediate transfer belt 41.

The number of the primary transfer rollers 45 can be arbitrarily set according to the number of the development units 30. Here, the transfer unit 40 includes, for example, five primary transfer rollers 45 (45W, 45K, 45C, 45M, and 45Y) corresponding to the above-mentioned five development units 30 (30W, 30K, 30C, 30M, and 30Y), respectively. Also, the transfer unit 40 includes one secondary transfer roller 46 corresponding to one backup roller 44.

The secondary transfer roller 46 transfers (secondary-transfers) toner transferred to the intermediate transfer belt 41 to the medium M. This secondary transfer roller 46 is pressed against the backup roller 44 and comprises a metallic core material and an elastic layer such as a foamed rubber layer covering the outer circumferential face of the core material. Note that the secondary transfer roller 46 can rotate according to the movement of the intermediate transfer belt 41.

The cleaning blade 47 extends in the Y-axis direction and is contacted by (pressed against) the intermediate transfer belt 41. This cleaning blade 47 scrapes off unnecessary toner etc. remaining on the surface of the intermediate transfer belt 41.

As mentioned above, according to the change in the reflection state of light, the photosensor 48 detects the detection mark 120 made on the intermediate transfer belt 41. This photosensor 48 is, for example, a reflection-type photosensor or the like as mentioned above. The installation position of the photosensor 48 is not particularly limited as far as the position allows opposing the intermediate transfer belt 41 while being spaced apart from the intermediate transfer belt 41. Shown in FIG. 8 for example is a case where the photosensor 48 is disposed between the driven roller 42 and the backup roller 44.

Fuser Unit:

The fuser unit 50 performs a fusing process using toner transferred to the medium M by the transfer unit 40. Specifically, the fuser unit 50 fuses the toner with the medium M by applying a pressure while heating the toner transferred to the medium M by the transfer unit 40.

This fuser unit 50 comprises, for example, a heat application roller 51 and a pressure application roller 52.

The heat application roller 51 applies heat to the toner. This heat application roller 51 comprises, for example, a metal core of a hollow cylindrical shape, and a resin coating covering the surface of the metal core. The metal core contains, for example, at least one kind of metallic materials such as aluminum. The resin coating contains, for example, at least one kind of macromolecular materials such as tetrafluoroethylene-perfluoroalkylvinylether copolymer (PFA) and polytetrafluoroethylene (PTFE).

Installed inside the heat application roller 51 (metal core) is a heater for example, and the heater is a halogen lamp or the like for example. Disposed in the vicinity of the heat application roller 51 is a thermistor, for example, so as to be spaced apart from the heat application roller 51. This thermistor measures the surface temperature of the heat application roller 51 for example.

The pressure application roller 52 is pressed against the heat application roller 51 and applies a pressure to toner. This pressure application roller 52 is, for example, a metal bar. The metal bar contains, for example, at least one kind of metallic materials such as aluminum.

Carrying Rollers:

Each of the carrying rollers 61-68 comprises a pair of rollers disposed so as to oppose each other through the carrying routes R1-R5 of the medium M, and carries the medium M extracted by the forwarding roller 20.

When forming an image on only one side of the medium M, the medium M is carried along the carrying routes R1 and R2 by the carrying rollers 61-64 for example. Also, when forming an image on both sides of the medium M, the medium M is carried along the carrying routes R1-R5 by the carrying rollers 61-68 for example.

Carrying Route Switching Guides:

The carrying route switching guides 69 and 70 switch the carrying direction of the medium M according to conditions such as the mode of the image formed on the medium M (whether the image is formed on only one side of the medium M or on both sides of the medium M).

Other Components:

Note that the image forming apparatus can be provided with at least one kind of other components along with a series of components mentioned above.

The kinds of the other components are not particularly limited but are, for example, a controller that controls the whole image forming apparatus, a motor that rotates a below-mentioned photosensitive drum 32 etc., a power supply that applies voltages to a below-mentioned charging roller 33 etc., memory that stores various kinds of information, etc. For example, this controller can correct the movement amount of the intermediate transfer belt 41 as necessary by detecting the movement amount etc. of the intermediate transfer belt 41 utilizing the detection mark 120 as mentioned above.

2-2. Configuration of the Development Unit

Next, the configuration of the development unit 30 is explained. FIG. 9 schematically shows the planar configuration of the development unit 30 (30W, 30K, 30C, 30M, or 30Y).

The development units 30W, 30K, 30C, 30M, and 30Y have the same configuration except that, for example, the kinds (colors) of toner contained in their toner cartridges 39 are different.

Figure 9:
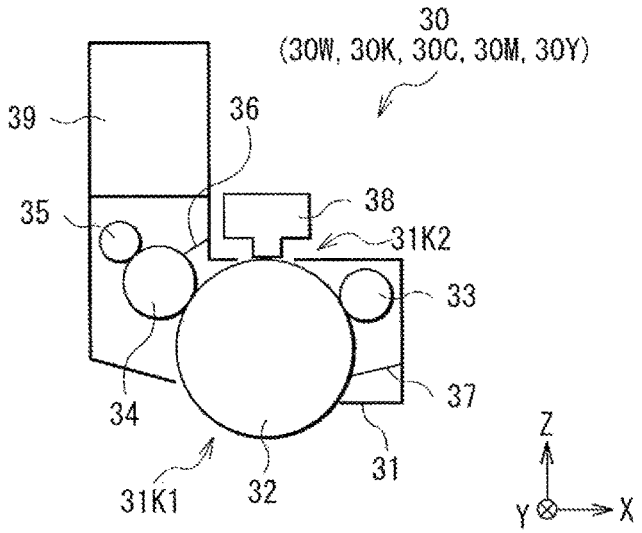
FIG. 9 is a plan view showing the configuration of a development unit.

As shown in FIG. 9 for example, each of the development units 30W, 30K, 30C, 30M, and 30Y is provided with a photosensitive drum 32, a charging roller 33, a development roller 34, a supply roller 35, a development blade 36, a cleaning blade 37, a light source 38, and the toner cartridge 39. Note that each of the development units 30W, 30K, 30C, 30M, and 30Y need not be provided with the light source 38 or the toner cartridge 39 for example. In this case, for example, the light source 38 or the toner cartridge 39 is externally attached to each of the development units 30W, 30K, 30C, 30M, and 30Y.

The photosensitive drum 32, the charging roller 33, the development roller 34, the supply roller 35, the development blade 36, and the cleaning blade 37 are, for example, contained inside a chassis 31. The light source 38 is, for example, disposed outside the chassis 31. The toner cartridge 39 is, for example, detachably attached to the chassis 31.

The photosensitive drum 32 is, for example, an organic photosensitive body comprising a conductive supporting body of a cylindrical shape and a photoconductive layer covering the outer circumferential face of the conductive supporting body, and can rotate through a drive source such as a motor. The conductive supporting body is, for example, a metal pipe containing at least one kind of metallic materials such as aluminum. The photoconductive layer is, for example, a laminated body comprising a charge generation layer, a charge transportation layer, etc. Part of the photosensitive drum 32 is exposed from an opening part 31K1 made on the chassis 31.

The charging roller 33 comprises, for example, a metal shaft and a semiconductive epichlorohydrin rubber layer covering the outer circumferential face of the metal shaft. This charging roller 33 is pressed against the photosensitive drum 32 in order to charge the photosensitive drum 32.

The development roller 34 comprises, for example, a metal shaft and a semiconductive urethane rubber layer covering the outer circumferential face of the metal shaft. This development roller 34 carries toner supplied from the supply roller 35 and also lets the toner adhere to an electrostatic latent image formed on the surface of the photosensitive drum 32.

The supply roller 35 comprises, for example, a metal shaft and a semiconductive foamed silicone sponge layer covering the outer circumferential face of the metal shaft, and is so-called a sponge roller. This supply roller 35 supplies toner to the surface of the photosensitive drum 32 while being slide-contacted the development roller 34.

The development blade 36 regulates the thickness of toner supplied to the surface of the development roller 34. This development blade 36 is disposed, for example, in a position spaced apart from the development roller 34 by a predetermined distance, the toner thickness is controlled based on the distance (interval) between the development roller 34 and the development blade 36. Also, the development blade 36 contains, for example, at least one kind of metallic materials such as stainless steel.

The cleaning blade 37 is a plate-shape elastic member that scrapes off unnecessary toner etc. remaining on the surface of the photosensitive drum 32. This cleaning blade 37 extends in an approximately parallel direction to the extending direction of the photosensitive drum 32 for example, and is pressed against the photosensitive drum 32. Also, the cleaning blade 37 contains, for example, at least one kind of macromolecular materials such as urethane rubber.

The light source 38 is an exposure device that forms an electrostatic latent image on the surface of the photosensitive drum 32 by exposing the surface of the photosensitive drum 32 with light through an opening part 31K2 made on the chassis 31. This light source 38 is, for example, a light emitting diode (LED) head, comprising LED elements and a lens array. The LED elements and the lens array are disposed so that light (irradiation light) output from the LED elements forms an image on the surface of the photosensitive drum 32.

The toner cartridges 39 contain toner for example. The kinds (colors) of toner contained in the toner cartridges 39 are as follows for example. The toner cartridge 39 of the development unit 30W contains white toner for example. The toner cartridge 39 of the development unit 30K contains black toner for example. The toner cartridge 39 of the development unit 30C contains cyan toner for example. The toner cartridge 39 of the development unit 30M contains magenta toner for example. The toner cartridge 39 of the development unit 30Y contains yellow toner for example.

2-3. Operations

Next, the operations of the image forming apparatus are explained.

In forming an image on the surface of the medium M, as explained below for example, the image forming apparatus performs a development process, a primary transfer process, a secondary transfer process, and the fusing process in this order, and performs a cleaning process as necessary.

Development Process:

First, the medium M contained in the tray 10 is extracted by the forwarding roller 20. The medium M extracted by the forwarding roller 20 is carried in the direction of an arrow F1 along the carrying route R1 by the carrying rollers 61 and 62.

Subsequently, in the development process, when the photosensitive drum 32 rotates in the development unit 30W, the charging roller 33 applies a direct current voltage to the surface of the photosensitive drum 32 while rotating. Thereby, the surface of the photosensitive drum 32 is uniformly charged.

Subsequently, based on image data externally supplied to the image forming apparatus, the light source 38 radiates light onto the surface of the photosensitive drum 32. Thereby, on the surface of the photosensitive drum 32, because the surface electric potential becomes attenuated (optically attenuated) on the part irradiated with light, an electrostatic latent image is formed on the surface of the photosensitive drum 32.

On the other hand, in the development unit 30W, toner (white toner) contained in the toner cartridge 39 is discharged toward the supply roller 35.

Subsequently, after a voltage is applied to the supply roller 35, the supply roller 35 rotates. Thereby, toner is supplied onto the surface of the supply roller 35.

Subsequently, after a voltage is applied to the development roller 34, the development roller 34 rotates while being pressed against the supply roller 35. Thereby, toner supplied to the surface of the supply roller 35 is adsorbed on the surface of the development roller 34, and the toner is carried utilizing the rotation of the development roller 34. In this case, because part of the toner adsorbed on the surface of the development roller 34 is removed by the development blade 36, the thickness of the toner adsorbed on the surface of the development roller 34 is homogenized.

Subsequently, after the photosensitive drum 32 rotates while being pressed against the development roller 34, the toner adsorbed on the surface of the development roller 34 migrates to the surface of the photosensitive drum 32. Thereby, the toner adheres to the surface of the photosensitive drum 32 (the electrostatic latent image).

Primary Transfer Process:

Subsequently, in the transfer unit 40, when the drive roller 43 rotates, the driven roller 42 and the backup roller 44 rotate according to the rotation of the drive roller 43. Thereby, the intermediate transfer belt 41 moves in the direction of the arrow F5.

In the primary transfer process, a voltage is applied to the primary transfer roller 45W. Because this primary transfer roller 45W is pressed against the photosensitive drum 32 through the intermediate transfer belt 41, in the above-mentioned development process, the toner adhering to the surface of the photosensitive drum 32 (electrostatic latent image) is transferred to the surface of the intermediate transfer belt 41.

Afterwards, the intermediate transfer belt 41 to which the toner is transferred continues to move in the direction of the arrow F5. Thereby, by the development units 30K, 30C, 30M, and 30Y, and the primary transfer rollers 45K, 45C, 45M, and 45Y, the development process and the primary transfer process are performed through the same procedure as by the development unit 30W and the primary transfer roller 45W mentioned above. Therefore, black toner, cyan toner, magenta toner, and yellow toner are transferred to the surface of the intermediate transfer belt 41.

Specifically, by the development unit 30K and the primary transfer roller 45K, black toner is transferred to the surface of the intermediate transfer belt 41. By the development unit 30C and the primary transfer roller 45C, cyan toner is transferred to the surface of the intermediate transfer belt 41. Subsequently, by the development unit 30M and the primary transfer roller 45M, magenta toner is transferred to the surface of the intermediate transfer belt 41. Subsequently, by the development unit 30Y and the primary transfer roller 45Y, yellow toner is transferred to the surface of the intermediate transfer belt 41.

Of course, whether the development process and the primary transfer process are actually performed by the development unit 30W, 30K, 30C, 30M, or 30Y and the primary transfer roller 45W, 45K, 45C, 45M, or 45Y is determined according to the necessary colors (combination of colors) for forming an image.

Secondary Transfer Process:

Subsequently, the medium M carried along the carrying route R1 passes between the backup roller 44 and the secondary transfer roller 46.

In the secondary transfer process, a voltage is applied to the secondary transfer roller 46. Because this secondary transfer roller 46 is pressed against the backup roller 44 through the medium M, toner transferred to the intermediate transfer belt 41 in the above-mentioned primary transfer process is transferred to the medium M.

Fusing Process:

Subsequently, after toner is transferred to the medium M in the secondary transfer process, the medium M continues to be carried in the direction of the arrow F1 along the carrying route R1, and thereby is injected to the fuser unit 50.

In the fusing process, the surface temperature of the heat application roller 51 is controlled so as to become predetermined temperature. When the pressure application roller 52 rotates while being pressed against the heat application roller 51, the medium M is carried so as to pass between the heat application roller 51 and the pressure application roller 52.

Thereby, because toner transferred to the surface of the medium M is heated, the toner melts. In addition, because toner in a molten state is pressed against the medium M, the toner adheres strongly to the medium M.

Therefore, based on image data externally supplied to the image forming apparatus, toner is fused with specific regions on the surface of the medium M, thereby forming an image.

The medium Mon which the image is formed is carried in the direction of an arrow F2 by the carrying rollers 63 and 64 along the carrying route R2. Thereby, the medium M is ejected to the stacker part 2 through the ejection port 1H.

Note that the carrying procedure of the medium M is changed according to the mode of the image formed on the medium M.

For example, when an image is formed on both sides of the medium M, the medium M that passed through the fuser unit 50 is carried in the direction of arrows F3 and F4 by the carrying rollers 65-68 along the carrying routes R3-R5, and afterwards carried again in the direction of the arrow F1 by the carrying rollers 61 and 62 along the carrying route R1. In this case, the direction in which the medium M is carried is controlled by the carrying route switching guides 69 and 70. Thereby, on the back side of the medium M (the face where no image is formed yet), the development process, the primary transfer process, the secondary transfer process, and the fusing process are performed.

Cleaning Process:

(Photosensitive Drum Cleaning Process)

In each of the development units 30W, 30K, 30C, 30M, and 30Y, unnecessary toner occasionally remains on the surface of the photosensitive drum 32. This unnecessary toner is, for example, part of toner used in the primary transfer process, such as toner that was not transferred to the intermediate transfer belt 41 and remains on the surface of the photosensitive drum 32.

Then, because the photosensitive drum 32 rotates in a state of being pressed against the cleaning blade 37, toner remaining on the surface of the photosensitive drum 32 is scraped off by the cleaning blade 37. Therefore, unnecessary toner is removed from the surface of the photosensitive drum 32.

(Intermediate Transfer Belt Cleaning Process)

Also, in the transfer unit 40, part of toner that migrated to the surface of the intermediate transfer belt 41 in the primary transfer process occasionally remains on the surface of the intermediate transfer belt 41 without migrating to the surface of the medium M in the secondary transfer process.

Then, when the intermediate transfer belt 41 moves in the direction of the arrow F5, toner remaining on the surface of the intermediate transfer belt 41 is scraped off by the cleaning blade 47. Therefore, unnecessary toner is removed from the surface of the intermediate transfer belt 41.

2-4. Actions and Effects

In this image forming apparatus, because the transfer unit 40 is provided with the belt unit of an embodiment of this invention mentioned above, for the same reason explained about the belt unit, the operating performance of the transfer unit 40 is enhanced. Therefore, the operating performance of the image forming apparatus can be enhanced.

Especially, as mentioned above, because it becomes harder for unnecessary toner to invade the interior of the detection mark 120 (the main recess part 121 and the auxiliary recess part 122), it becomes harder for toner to remain on the surface of the intermediate transfer belt 41. Therefore, it becomes harder for toner remaining on the surface of the intermediate transfer belt 41 to be transferred to the surface of the medium M, which can suppress the phenomenon that the medium M becomes dirty. In this case, of course, the phenomenon that the image formed on the surface of the medium M becomes dirty can also be suppressed.

Note that other actions and effects of the image forming apparatus are the same as the actions and effects of the belt unit mentioned above.

3. Modifications

The configuration and the manufacturing method of the belt unit shown in FIGS. 1-6 can be changed as appropriate.

Figure 10:
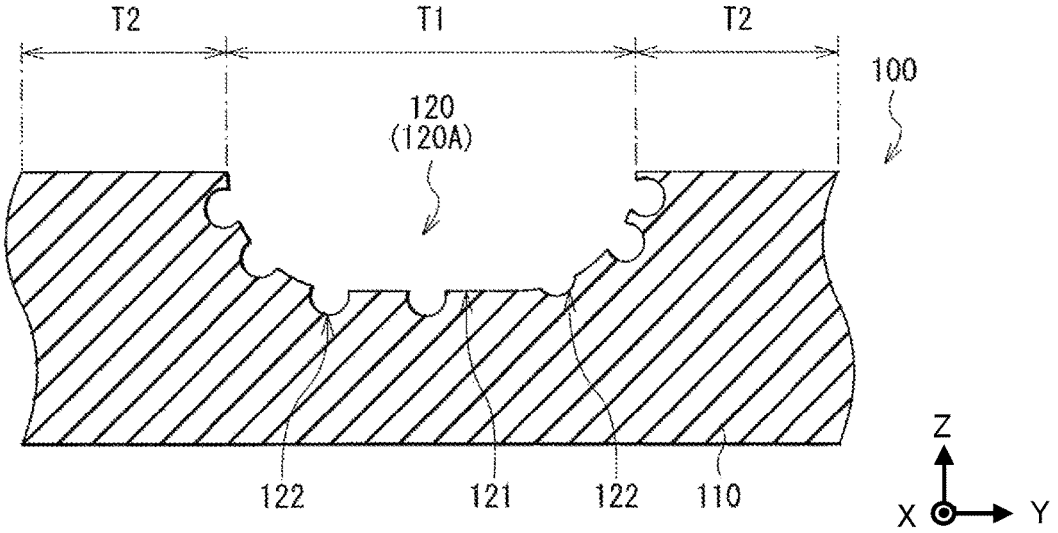
FIG. 10 is a cross-sectional view showing the first modification of the configuration of the belt unit.

Modification 1:

Specifically, as shown in FIG. 10 corresponding to FIG. 4, the belt member 110 need not internally have the multiple voids 123. In this case also, by utilizing the detection mark 120 having the main recess part 121 and the auxiliary recess part 122, the same effects can be obtained.

Figure 11:
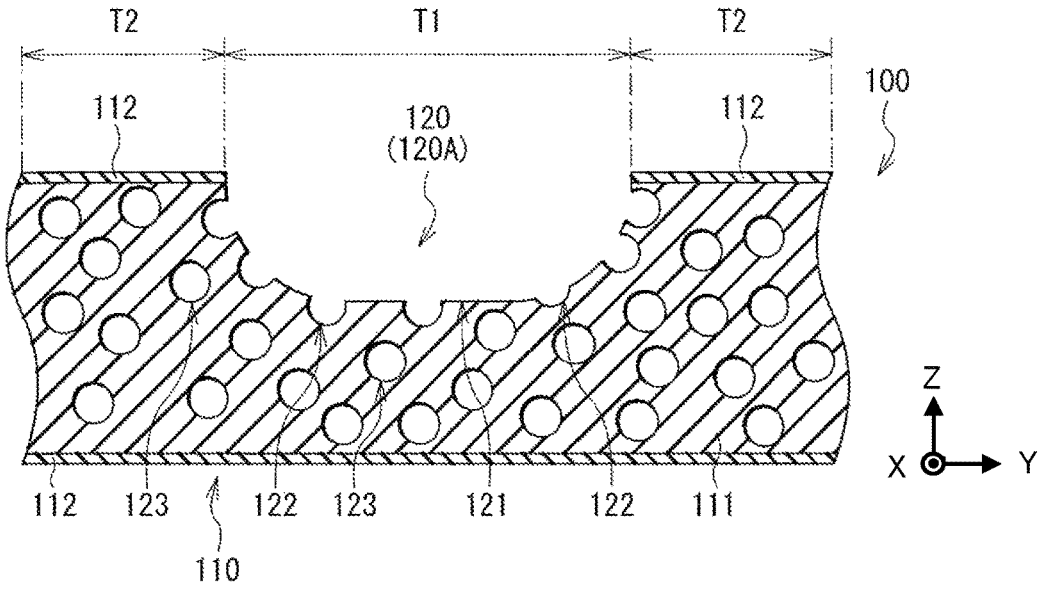
FIG. 11 is a cross-sectional view showing the second modification of the configuration of the belt unit.

Modification 2:

Also, for example, as shown in FIG. 11 corresponding to FIG. 4, the belt member 110 can comprise an inner layer 111 and a surface layer 112 covering the surface of the inner layer 111.

The inner layer 111 is a layer corresponding to the belt member 110 shown in FIG. 4, and as mentioned above for example, contains at least one kind of macromolecular materials such as polyimide.

The surface layer 112 is a layer that mainly performs a role of enhancing the smoothness of the surface of the belt 100, and is so-called a skin layer. This surface layer 112 can contain, for example, either the same material as the forming material of the inner layer 111 or a different material from the forming material of the inner layer 111. As mentioned above, because the role of the inner layer 111 and the role of the surface layer 112 are different from each other, for example, whereas the inner layer 111 internally has the multiple voids 123, the surface layer 112 need not internally have the multiple voids 123. Note that in order to form the surface layer 112 that does not have the multiple voids 123, for example, the method disclosed in Japanese Unexamined Patent Application 2015-102601 can be used in forming the belt member 110.

Along with this, if the belt member 110 includes the surface layer 112, in order to form the auxiliary recess part 122 easily by utilizing the multiple voids 123, as shown in FIG. 11, the main recess part 121 should preferably be formed so as to penetrate the surface layer 112 and remove part of the inner layer 111.

In this case also, because the detection mark 120 having the main recess part 121 and the auxiliary recess part 122 is formed, the same effects as in the case shown in FIG. 4 can be obtained.

Figure 12:
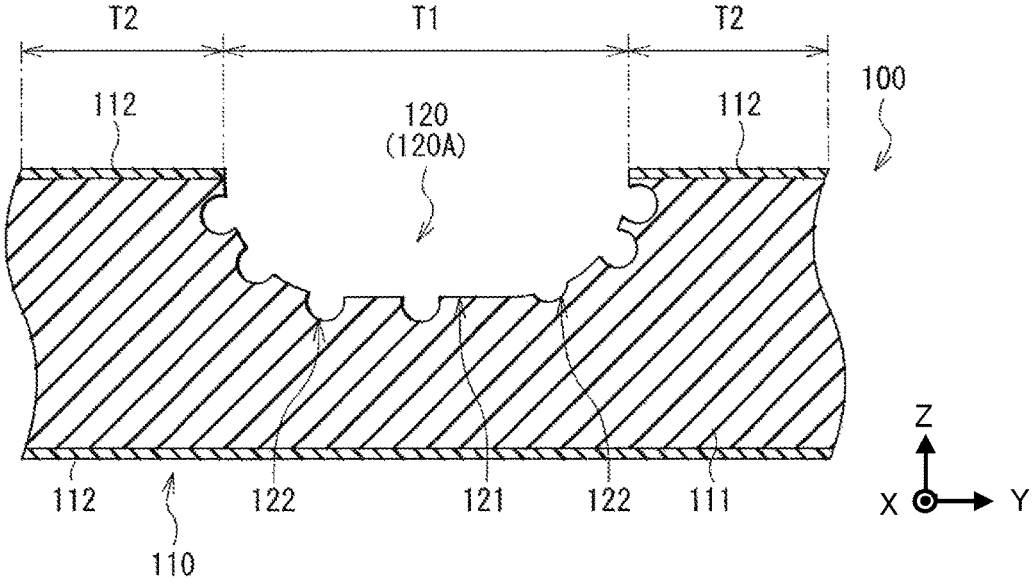
FIG. 12 is a cross-sectional view showing the third modification of the configuration of the belt unit.

Modification 3:

Of course, for example, as shown in FIG. 12 corresponding to FIGS. 10 and 11, if the belt member 110 comprises the inner layer 111 and the surface layer 112, the belt member 110 need not internally have the multiple voids 123. In this case also, by forming the main recess part 121 so as to penetrate the surface layer 112 and remove part of the inner layer 111, the detection mark 120 having the main recess part 121 and the auxiliary recess part 122 becomes available, therefore the same effects can be obtained.

Modification 4:

As shown in FIGS. 4 and 6, although the laser irradiation process was used for forming the main recess part 121 by removing part of the belt member 110, other processes can be used.

Specifically, the other processes are, for example, a dissolution process, an etching process, and the like. That is, if the belt member 110 has solubility to a solvent, by dissolving part of the belt member 110 using the solvent, part of the belt member 110 can be removed. The kind of the solvent is not particularly limited but is at least one kind of organic solvents or the like for example. Note that the kind of the etching process is not particularly limited.

In this case also, because the detection mark 120 having the main recess part 121 and the auxiliary recess part 122 is formed, the same effects can be obtained. Of course, two kinds or more of the other processes mentioned above can be combined for removing part of the belt member 110. Also, the laser irradiation process and at least one kind of the other processes can be used for forming the auxiliary recess part 122.

Not being limited to the case of forming the detection mark 120 shown in FIG. 4, the other processes explained here can be applied to the cases of forming the detection mark 120 shown in FIGS. 10-12.

Modification 5:

Note that in the case where the belt member 110 includes the surface layer 112 (FIGS. 11 and 12), if it is hard to remove the surface layer 112 using the laser irradiation process or the other processes mentioned above, yet other processes can be used for removing the surface layer 112.

Specifically, the yet other processes are, for example, a polishing process and the like. In this case, after removing the surface layer 112 using the polishing process or the like, part of the inner layer 111 can be removed using the laser irradiation process or the like. In this case also, because the main recess part 121 is formed so as to penetrate the surface layer 112 and remove part of the inner layer 111, the same effects can be obtained.

EMBODIMENTS

Embodiments of this invention are explained in detail. Note that the order of the explanations is as follows.

1. Manufacture of the belts
2. Evaluation of the belts
3. Considerations

1. Manufacture of the Belts

Belts were manufactured through the following procedures.

Experimental Example 1

A belt was manufactured by forming a detection mark having the main recess part and the auxiliary recess part.

In manufacturing the belt, first, a belt member in a state where the detection mark is not yet formed was prepared. As the belt member, foamed polyamide-imide (thickness=83 μm) manufactured by Sumitomo Riko Company, Ltd. was used. This belt member comprises an inner layer (polyamide-imide) and a surface layer (polyamide-imide, thickness=2-4 μm), and multiple voids inside the inner layer. The average particle size (median diameter D50) of the multiple voids is 0.1-2 μm.

Subsequently, part of the surface of the belt member was irradiated with laser and afterwards repeatedly scanned with the laser, thereby the part of the belt member was removed. In this case, the laser scanning direction was set to the X-axis direction in FIG. 6. The other irradiation conditions such as laser output were adjusted as appropriate so that the depth (maximum depth) of the main recess part formed finally becomes a desired value.

Thereby, the main recess part was formed in a place where the belt member was partially removed, and the multiple auxiliary recess parts were formed on the inner wall face of the main recess part, thereby forming a detection mark having the main recess part and the auxiliary recess parts. The planar shape of the detection mark was set to a rectangle. The dimensions of the detection mark were set so that the length of the long side=7 mm, the length of the short side=6 mm, and the depth (maximum depth)=7 mm.

Therefore, a belt having the detection mark was completed. In this case, when the surface and the cross section of the belt in the area where the detection mark was formed were observed using a scanning electron microscope (SEM), as shown in FIG. 4, the multiple auxiliary recess parts made on the inner wall face of the main recess part were observed. This "surface" indicates the surface of the belt viewed in the Z-axis direction in FIG. 4, and the "cross section" indicates the cross section of the belt along the X-Z plane shown in FIG. 4.

Experimental Example 2

As a comparison, a belt was manufactured by forming a detection mark having only the main recess part. In this case, in the same manner as in Experimental example 1, when the surface and the cross section of the belt were observed using a scanning electron microscope, as shown in FIG. 7, only the main recess part was observed, and multiple auxiliary recess parts were not observed.

In manufacturing the belt, the same procedure as in Experimental Example 1 was used except that polyamide-imide (thickness=60 μm) manufactured by Gunze Limited was used as a belt member in a state where the detection mark is not formed yet. This belt member comprises an inner layer (polyamide-imide) and a surface layer (polyamide-imide, thickness=2-4 μm) but does not have multiple voids inside the inner layer.

Experimental Examples 3-21

Belts were manufactured through the same procedure as in Experimental example 1 except that the surface roughness of the detection mark was changed by changing the intensity of laser in the forming process of the detection mark (main recess part).

2. Evaluation of the Belts

Concerning Experimental examples 1 and 2, when the surface roughness and the detection performance were examined as the physical properties of the detection marks, the results shown in Table 1 were obtained.

In examining the surface roughness, through the above-mentioned procedure, 10-point average roughnesses Rz1 and Rz2 (μm) of the detection marks were measured. Note that because the 10-point average roughness Rz2 is a parameter defined for a detection mark having the auxiliary recess part along with the main recess part, in Table 1 the 10-point average roughness Rz2 is shown only for Experimental example 1.

In examining the detection performance, the received light voltage difference ΔV (V) was calculated using a photosensor and an oscilloscope. In this case, the setting was made so that the received light voltage from the belt surface became 2.8 V. Also, by sprinkling toner on the surface of the detection mark and afterwards strongly rubbing the surface of the detection mark, a carbon residue generated by the laser irradiation process was removed.

TABLE 1

| Examples | Detection Mark: Main Recess Part | Detection Mark: Auxiliary Recess Part | 10-point average roughness Rz1 (μm) | 10-point average roughness Rz2 (μm) | Received Light Volt. Difference ΔV (V) |
|---|---|---|---|---|---|
| 1 | with | without | 3.2 | 5.5 | 1.48 |
| 2 | with | without | 1.0 | — | 0.40 |

Also, concerning Experimental examples 1 and 3-21, when the operating performance was examined as the performance of the image forming apparatus having the transfer unit (belt unit) built-in was examined, along with the physical properties of the detection mark (the surface roughness and the detection performance), the results shown in Table 2 were obtained.

In examining the operating performance, using the image forming apparatus having magenta toner (volume average particle size=7 μm) mounted, a process of forming a magenta solid image (coverage rate=100%) on the surface of the medium was repeated 100 times. Afterwards, whether toner invaded the interior of the detection mark was visually checked, and whether unnecessary toner adheres to the surface of the medium (outside the proper image formation range) was also visually checked. In this case, a color printer MICROLINE VINCI C941dn manufactured by Oki Data Corporation was used as the image forming apparatus, and A4 printer sheet (Excellent White, size=297 mm×210 mm) manufactured by Oki Data Corporation was used as the medium.

In the column of "Toner invasion" shown in Table 2, the case where toner invaded the interior of the detection mark is listed as "Occurred", and the case where toner did not invade the interior of the detection mark is listed as "Not occurred". Also, in the column of "Image dirtiness", the case where image dirtiness occurred because unnecessary toner adhered to the surface of the medium is indicated as "Occurred", and the case where image dirtiness did not occur because unnecessary toner did not adhere to the surface of the medium is indicated as "Not occurred".

TABLE 2

| Examples | Detection Mark: Main Recess Part | Detection Mark: Auxiliary Recess Part | 10-point average roughness Rz2 (μm) | Received Light Volt. Difference ΔV (V) | Toner Invasion | Image Dirtiness |
|---|---|---|---|---|---|---|
| 3 | with | with | 2.2 | 0.50 | No | No |
| 4 | | | 3.1 | 0.72 | No | No |
| 5 | | | 3.3 | 0.92 | No | No |
| 6 | | | 4.0 | 1.16 | No | No |
| 7 | | | 4.1 | 1.36 | No | No |
| 8 | | | 4.5 | 1.34 | No | No |
| 9 | | | 4.6 | 1.42 | No | No |
| 10 | | | 5.3 | 1.44 | No | No |
| 11 | | | 5.4 | 1.44 | No | No |
| 12 | | | 5.6 | 1.46 | No | No |
| 13 | | | 6.4 | 1.54 | No | No |
| 14 | | | 6.5 | 1.54 | No | No |
| 15 | | | 7.0 | 1.56 | No | No |
| 16 | | | 7.3 | 1.50 | No | No |
| 17 | | | 7.6 | 1.54 | No | No |
| 18 | | | 8.2 | 1.58 | No | No |
| 19 | | | 9.1 | 1.64 | Yes | Yes |
| 20 | | | 9.4 | 1.62 | Yes | Yes |
| 21 | | | 10.2 | 1.70 | Yes | Yes |

Note:
In columns of Toner Invation and Image dirtiness, No means that no target effect was found. Yes means that the target effect was found.

3. Considerations

As is clear from Table 1, in the case where the detection mark had the auxiliary recess part along with the main recess part (Experimental example 1), the physical properties of the detection mark were enhanced in comparison with the case where the detection mark had only the main recess part (Experimental example 2).

Specifically, in the case where the detection mark had the auxiliary recess part along with the main recess part, the 10-point average roughness Rz1 significantly increased in comparison with the case where the detection mark had only the main recess part. This result indicates that if the detection mark having the auxiliary recess part along with the main recess part is irradiated with light, it becomes significantly easier for the light to be scattered.

Along with this, in the case where the detection mark had the auxiliary recess part along with the main recess part, the received light voltage difference ΔV significantly increased in comparison with the case where the detection mark had only the main recess part. This result indicates that if the detection mark has the auxiliary recess part along with the main recess part, because the difference between the amount of reflected light in the area where the detection mark is made and the amount of reflected light in the area where the detection mark is not made becomes significantly large, it became easier for the detection mark to be detected utilizing the difference in the amount of reflected light.

Also, as is clear from Table 2, in the case where the detection mark having the auxiliary recess part along with the main recess part was used (Experimental examples 1 and 3-21), the physical properties (received light voltage difference ΔV) of the detection mark and the operating performance (toner invasion and image dirtiness) of the image forming apparatus (transfer unit) varied greatly according to the surface roughness (10-point average roughness Rz2) of the detection mark.

Specifically, the received light voltage difference ΔV showed a trend of gradually increasing as the 10-point average roughness Rz2 increased, and the image dirtiness due to toner invasion showed a trend of gradually becoming more likely to occur as the 10-point average roughness Rz2 increased. In this case, when the 10-point average roughness Rz2 was 4.0-8.2 μm (Experimental examples 1 and 6-18), a high received light voltage difference ΔV of 1.00 V or higher was obtained, and no image dirtiness occurred due to toner invasion. Especially, when the 10-point average roughness Rz2 was 4.6-8.2 μm (Experimental examples 1 and 9-18), the received light voltage difference ΔV further increased while suppressing the occurrences of image dirtiness due to toner invasion.

Based on these, if the detection mark had the auxiliary recess part along with the main recess part, the physical properties of the detection mark were improved. Therefore, the detection precision of the detection mark was enhanced, enhancing the operating performance of the belt unit.

Although this invention was explained referring to an embodiment above, this invention is not limited to the modes explained in an embodiment mentioned above, but various kinds of modifications are possible.

Specifically, for example, the application of the belt unit of an embodiment of this invention is not particularly limited. The application of the belt unit is not limited to the transfer unit mentioned above, but can be a fuser unit using a heat application belt, or something else.

Also, for example, the image forming apparatus of an embodiment of this invention is not limited to a printer, but can be a copier, a facsimile machine, a multifunction peripheral, or the like.

What is claimed is:

1. A belt unit for carrying toner image, equipped in an image forming apparatus, comprising:

an endless belt having an circular length and an outer surface on which the toner image is placed, having a width in a shorter direction, a drive unit that is a pair of rollers, arranged inside the belt such that rotation axes of the rollers are in parallel in a longer direction in order to provide a tension to the belt, at least one of the rollers driving the belt, wherein a plurality of detective marks are aligned on the outer surface of the belt in the longer direction with a predetermined interval, these detective marks being positioned close to one of side edges of the belt, a distance between the detective marks and the one of the side edges of the belt being ranged between 3% to 10% of the width of the belt, and the interval being ranged between 5% to 30% of the circular length of the belt, each of the detective marks is formed with grooves, the grooves extending in the longer direction and arranged in parallel in the shorter direction, each of the grooves has an inner wall face, and a plurality of auxiliary recesses are formed on the inner wall face of the groove.

2. The belt unit according to claim 1, wherein a surface roughness (Rzjis), which is measured using a two-dimensional surface roughness meter of the inner wall face of the first recess part, is ranged inclusively between 4.0 μm and 8.2 μm.

3. An image forming apparatus comprising:

a development unit that forms a latent image and lets toner adhere to the latent image, the transfer unit that is provided with the belt unit according to claim 1, and transfers the toner adhering to the latent image to a medium, a fuser unit that fuses the toner transferred onto the medium with the medium, wherein the toner in the development unit has a volume average particle size that is ranged inclusively between 5-8 μm.

4. A transfer unit comprising:

the belt unit according to claim 1, and a cleaning member that contacts the outer surface of the belt of the belt unit, the grooves of the belt being disposed on the outer surface.

5. An image forming apparatus comprising:

a development unit that forms a latent image and lets toner adhere to the latent image, the transfer unit according to claim 4 that transfers the toner adhering to the latent image to a medium, and a fuser unit that fuses the toner transferred onto the medium with the medium.

* * * * *